US008302599B2

(12) United States Patent
Green

(10) Patent No.: US 8,302,599 B2
(45) Date of Patent: Nov. 6, 2012

(54) PROTECTIVE HEADGEAR SYSTEM WITH FILTER PROTECTOR

(75) Inventor: Lawrence Green, Santa Ana, CA (US)

(73) Assignee: Pabban Development, Inc., Irvine, CA (US)

( * ) Notice: Subject to any disclaimer, the term of this patent is extended or adjusted under 35 U.S.C. 154(b) by 0 days.

(21) Appl. No.: 13/066,776

(22) Filed: Apr. 26, 2011

(65) Prior Publication Data

US 2011/0240016 A1 Oct. 6, 2011

Related U.S. Application Data

(63) Continuation of application No. 12/799,451, filed on Apr. 26, 2010, now abandoned, which is a continuation of application No. 11/442,402, filed on May 30, 2006, now abandoned.

(51) Int. Cl.
*A62B 17/00* (2006.01)
*A62B 18/00* (2006.01)

(52) U.S. Cl. ..... 128/201.25; 128/201.22; 128/201.23; 128/201.24; 128/205.25; 128/206.21; 2/171.3; 2/182.3; 2/435; 2/436; 2/437

(58) Field of Classification Search ..... 128/201.22, 128/201.25, 201.23, 201.24, 205.25, 206.12, 128/206.21; 2/171.3, 182.3, 435–437
See application file for complete search history.

(56) References Cited

U.S. PATENT DOCUMENTS

| | | | | |
|---|---|---|---|---|
| 5,887,281 | A * | 3/1999 | Green et al. | 2/171.3 |
| 6,393,617 | B1 * | 5/2002 | Paris et al. | 2/171.3 |
| D460,584 | S * | 7/2002 | Green | D29/102 |
| 6,792,944 | B1 * | 9/2004 | Green et al. | 128/201.22 |
| 6,826,783 | B1 * | 12/2004 | Grove et al. | 2/424 |
| 6,918,141 | B2 * | 7/2005 | Green et al. | 2/424 |
| 7,213,271 | B1 * | 5/2007 | Bielefeld | 2/416 |
| 2005/0060788 | A1 * | 3/2005 | Green et al. | 2/171.3 |

FOREIGN PATENT DOCUMENTS

| | | | |
|---|---|---|---|
| GB | 2350546 | A * | 12/2000 |
| GB | 2389028 | A * | 12/2003 |

* cited by examiner

*Primary Examiner* — Clinton T Ostrup
(74) *Attorney, Agent, or Firm* — Moser Taboada

(57) ABSTRACT

This invention is directed to a protective headgear system which includes a relatively light weight, substantially rigid, headgear structure which may include an internal, adjustable headband. The system includes at least one filter which is attachable to the headgear structure to cover the structure and a filter protector mounted thereon. A fan mechanism is mounted on the headgear structure to draw air into the headgear structure through the filter means. A power supply selectively powers the fan. A facial shield is attachable to the headgear structure to cover the face of the wearer to maintain non-contaminating conditions relative to the wearer. A flexible cuff or hood is attachable to the facial shield to enclose the lower opening of the lens and provides protection for the wearer through which air can be exhausted.

20 Claims, 6 Drawing Sheets

PROTECTIVE HEADGEAR SYSTEM WITH FILTER PROTECTOR

This application is a continuation of application Ser. No. 12/799,451 filed Apr. 26, 2010 now abandoned which is a continuation of application Ser. No. 11/442,402 filed May 30, 2006 now abandoned.

BACKGROUND

1. Field of the Invention

This invention is directed to personal environmental protection systems, in general, and, more particularly, to a headgear structure which is worn by an individual in an environment wherein control of filtered air and protection from particulate material is required.

2. Prior Art

There are several types of air flow, filtration and protective systems which are known in the art. Several types of such systems are currently available on the market for use in surgical arenas, in "clean room" environments, or in hazardous/contaminated environments.

Some of the existing systems include hoods, gowns, filters, and the like. In some instances, the air filters are built into the helmet structure and produce a rather clumsy, cumbersome headgear unit. Known units frequently include external sources of air such as gas cylinders, air lines or the like which are connected to the helmet structure by tubes, hoses or the like. The hose-connected systems, and the long gowns or hoods tend to become extremely cumbersome as well as restrictive of the movements and flexibility of the wearer during a procedure.

In many of the systems known in the art the hoods and/or gowns are used as filtration devices which have to be replaced frequently. This structure tends, therefore, to become costly inasmuch as the disposable filtration devices are quite expensive.

Moreover, these systems tend to be fairly expensive, especially regarding the disposable portions of the system.

Many such products are known in the prior art. One suitable and functional system is described in U.S. Pat. No. 5,054,480; PERSONAL AIR FILTRATION AND CONTROL SYSTEM, R. O. Bare et al.

Another such system is described in U.S. Pat. No. 5,711,033; AIR FILTRATION AND CONTROL SYSTEM INCLUDING HEADGEAR by L. J. Green, et al.

The most pertinent prior disclosure is described in U.S. Pat. No. 6,918,141; PROTECTIVE HEADGEAR SYSTEM, by Lawrence J. Green, Celestino Murillo and Obed Rios.

SUMMARY OF THE INSTANT INVENTION

This invention is directed to a protective headgear system which is worn by a surgeon during a surgical procedure, a technician during an assembly process, a worker during handling of toxic wastes, or the like.

The system includes a relatively light weight, substantially rigid, support headgear structure. Typically, a fan mechanism is mounted on the headgear structure to provide air flow at the headgear structure. A suitable power supply, such as a battery pack or the like, can be used to selectively power the fan.

The system also includes one or more removable and disposable filters which are adapted to be easily and snugly attached to and supported by the headgear structure to significantly cover the outer surface of the headgear structure.

A transparent facial shield (or lens) is adapted to easily attach to the headgear structure so as to cover the face of the wearer in order to maintain sterile, non-contaminating conditions for the wearer.

A flexible containment cuff is adapted to be easily attached to the lower edge of the facial shield in order to enclose the lower projection of the lens and provide a sealed space about the wearer's head. In one embodiment, the cuff can be closed around the wearer's neck.

An adjustable headband is attached to the headgear structure for supporting the assembled structure on the wearer's head.

An outer, relatively lightweight, substantially rigid filter protector is provided for mounting to the lens in at least a partially spaced apart relationship to provide an air gap between the lens and the filter protector.

DESCRIPTION OF A PREFERRED EMBODIMENT

Figure 1:
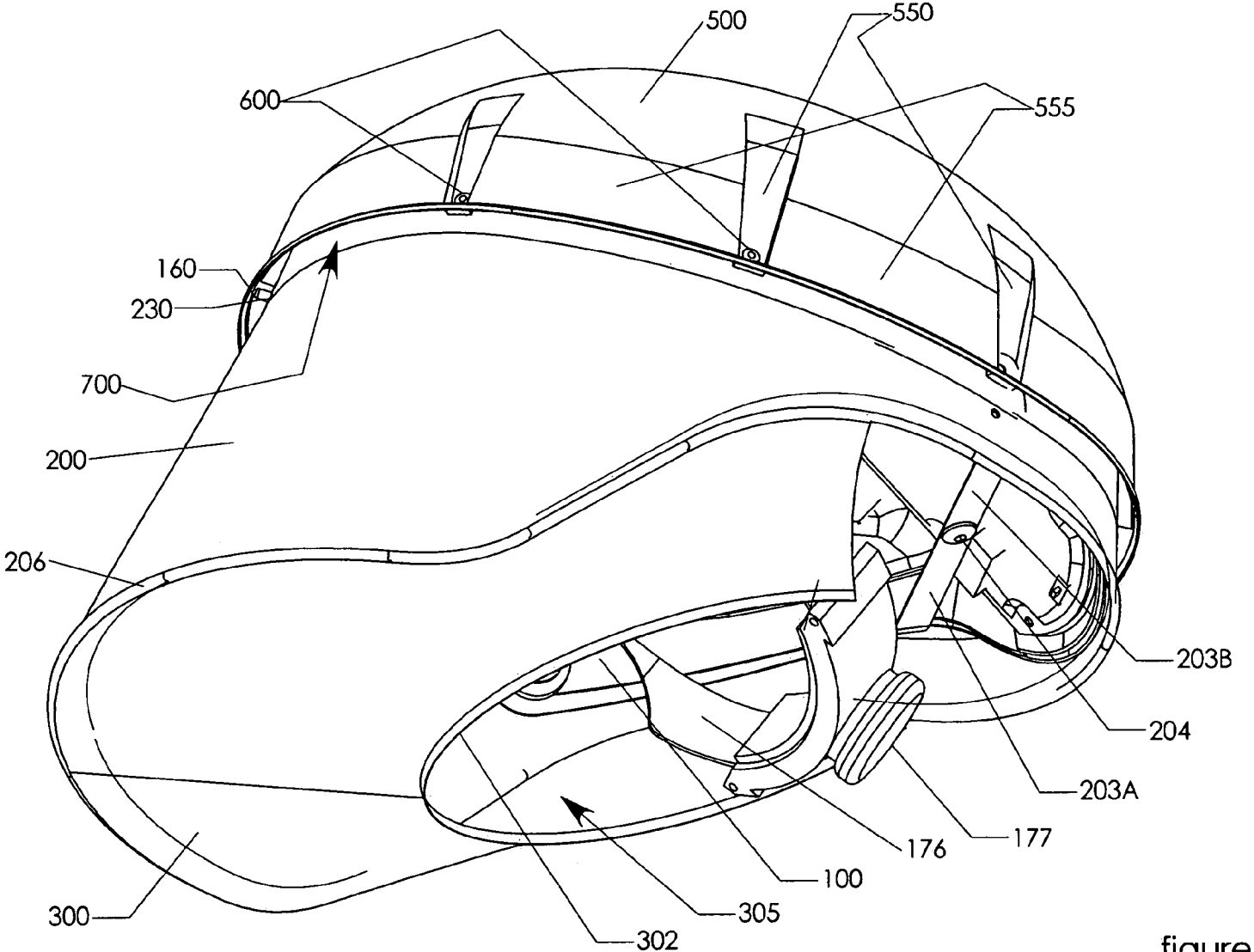
FIG. 1 is a perspective view of one embodiment of the assembled helmet system of the instant invention.
Figure 2:
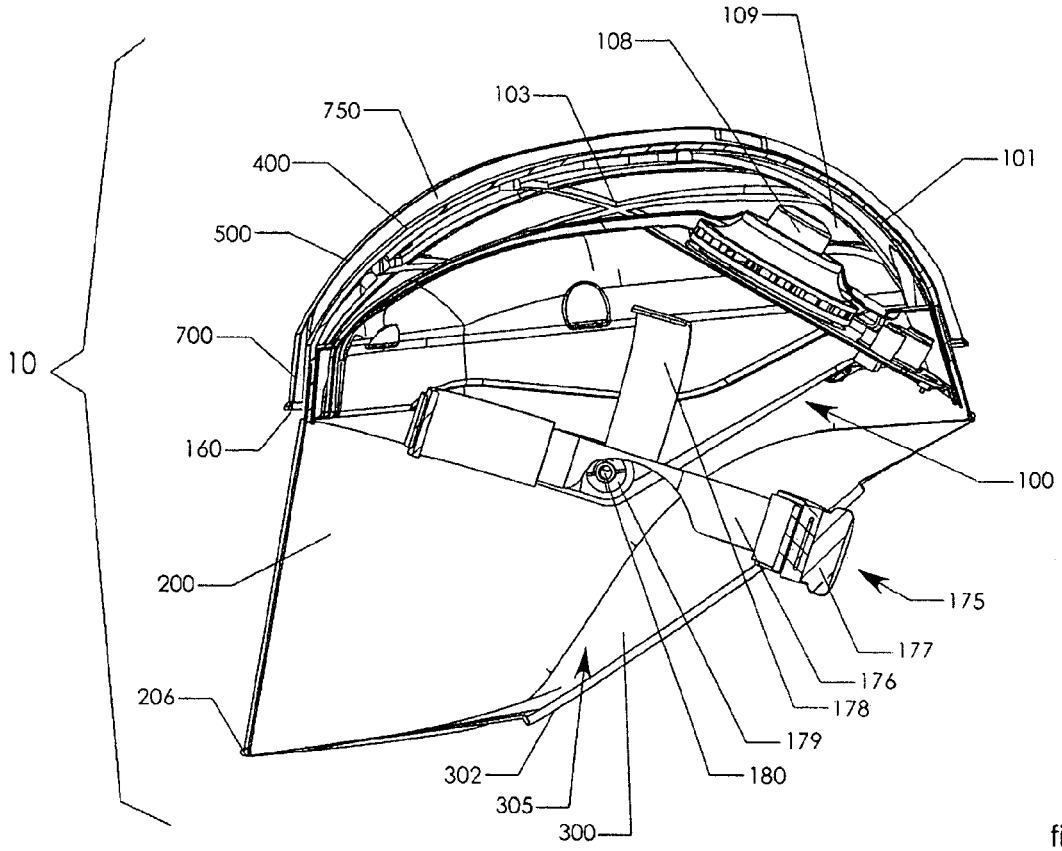
FIG. 2 is a cross-sectional view of the embodiment of the assembled helmet system shown in FIG. 1.

Referring concurrently to FIGS. 1 through 4, there is shown one embodiment of the helmet assembly 10 of the instant invention. The helmet assembly 10 includes the helmet shell 100, the fan mechanism 108 mounted on the helmet shell, the outer filter protector 500, the main filter 400, the facial shield 200, the cuff 300, and the headband assembly 175.

The headband 175 is used to seat the helmet 10 on the head of the wearer (not shown). The headband 175 is fairly conventional and is, also, optional. That is, a different head engaging support mechanism can be utilized or it can be omitted, if preferred.

The headband 175 includes the head-encircling band 176 which is adjustable to comfortably fit the head size of the individual wearer. The adjustment latch 177 permits the band 176 to be shortened or lengthened in a conventional manner.

An over-the-head strap 178 is attached to the band 176 in any conventional fashion. The band 176 and strap 178 may be integrally formed, if so desired. The strap and band are formed of a suitable material, such as nylon, for example. While adjustment of the length of strap 178 is contemplated, this is not a required feature of the invention, per se.

The headband 176 includes suitable attachment arms 179 (see FIG. 5) which extend outwardly from the headband 176. The arms 179 are provided for attachment to the helmet 100 by means of suitable fasteners 180 which can be pan screws or the like, as discussed supra.

A suitable socket 181 at each side of the helmet shell 100 and a suitable socket 171 at each side of the headband 175 (seen best in FIG. 3) is provided for receiving connectors 180, such as pan screws or the like, to secure headband 175 to the helmet shell as described infra.

The helmet shell 100 is, typically, formed of a lightweight material, such as PETG (PolyEthylene Terephtalate Glycol-modified) or polycarbonate, for example.

Helmet shell 100 is configured to conform, generally, to the shape of the upper portion of the wearer's head but to be spaced away from the top of the head of the wearer by the headband 175 described infra.

In addition, as will be described infra, the helmet shell 100 is sufficiently sturdy, firm or strong so as to support a cooling or air moving mechanism 108, typically, e.g. a fan or the like.

A plurality of radial ribs 103 extend upwardly from the outer surface of the helmet shell 100 and radiate upwardly and outwardly from the longitudinal center of the helmet shell 100 toward the perimeter thereof. The ribs 103 may be integral with the helmet shell 100 and formed in an inverted basket shape although this configuration is not required.

A fan covering 101 extends above the outer surface of helmet shell 100. The fan covering 101 is joined to or is integrally formed with ribs 103 to provide a protective and contouring cover for the fan mechanism 108 of any conventional type as, for example, described in U.S. Pat. Nos. 460,584 and 6,792,944. Thus, the fan covering 101, in conjunction with ribs 103, provides a spacer for maintaining a distance between the helmet shell 100 and filter 400. A fan opening 109 is provided through the side portion of the fan covering 101.

The fan covering 101, as well as ribs 103, serve to support the protective filter 400 above the helmet shell 100. Thus, air flow channels can be defined and maintained around the helmet assembly 10 whereby the fan mechanism 108 can provide a cooling and filtered air flow to the wearer of the helmet assembly 10.

A mounting pin 160 is attached to the front of the helmet shell 100. The mounting pin 160 is provided to receive and position facial shield (or lens) 200 as well as filter 400, as described infra.

A filter 400 typically, but not limitatively, fabricated of electrostatically charged fibrous plastic material (melt blown polypropylene) is configured to conform to the outer shape of the helmet shell 100 and is adapted to fit fairly snugly thereto. By selecting the material of the filter 400, the level or degree of filtration of air which enters or leaves the helmet shell 100 can be controlled.

The front edge 402 of filter 400 is secured to helmet shell 100 with any suitable fastener such as Velcro, or the like. In addition, the filter 400 includes an aperture 403 therein through which mounting pin 160 extends to position the filter 400. As will be described infra, the top edge of lens 200 clamps the perimeter of the main filter 400 to the helmet shell 100.

In this embodiment, a filter protector 500 is provided to cover the filter 400. The filter protector 500 can be fabricated of a material which is the same as (or similar to) helmet shell 100, if so desired. The filter protector 500 prevents damage to the filter 400 and, as well, prevents persons (including the helmet wearer) from touching the possibly contaminated surface of filter 400.

The filter protector 500 is attached to the upper edge portion of the lens 200, for example by rivets 600. In particular, the protector 500 includes a plurality of indented sections 550 (or standoffs) through which the rivets 600 are inserted. The sections 555 of filter protector 500 which are intermediate the indented sections 550 are spaced away from the surface of the upper edge portion of the lens 200 thereby providing the gap 700 through which air can pass into the enclosed space above the filter.

Additionally, the filter protector has an upper indented detail 530 which bears on the upper rear surface 430 of filter 400 which, in turn, bears on fan covering 101 thereby providing a standoff from the filter 400 and maintaining separation 750 between filter 400 and filter protector 500.

A facial lens 200 fabricated of an impervious, transparent material such as polycarbonate, or the like, is adapted to be mounted on the outer surface of helmet shell 100. The lens 200 may include a sealing gasket fabricated of a closed cell foam or other compressible material mounted at the upper, substantially linear edge thereof. The lens 200 is adapted to bear against the outer surface of the filter 400 which in turn bears on the outer surface of the helmet shell 100 thereby clamping the perimeter of the filter 400 in place. The juxtaposition of the inner surface of the filter 400 and the outer surface of the helmet shell 100 provides a secure, hermetic seal between the inner surface of the filter 400 and the outer surface of the helmet shell 100. In like manner, the inner surface of the lens 200 is sealed to the outer surface of the filter 400.

In one embodiment, the filter protector 500 and the lens 200 are fabricated and adapted to conform to the perimeter shape of the helmet shell 100. In this case, a suitable locking device is provided to secure the lens 200 to the helmet shell 100. In one embodiment, the locking device can comprise a pair of holding tabs 203A and 203B attached to lens 200 by rivets or the like, and a snap connector 204 (comprised of the snap components 204A and 204B). Other locking techniques are contemplated, as well.

A positioning aperture 230 is provided at the center of the shield 200 adjacent the upper edge thereof. The aperture 230 is placed over the mounting pin 160 on the helmet shell 100, as described supra, to position the shield 200 relative to the helmet shell 100.

It is also contemplated that the positioning aperture as well as the tabs 203A and 203B can be incorporated into the filter protector 500 such that the filter protector 500 can function as an integrated assembly.

In addition, one side of a zipper 206, viz. zipper side 206A, is attached to the lower, curvilinear edge of lens 200 for attachment of the cuff 300, as described infra. The other side of zipper 206, viz. zipper side 206B, is attached to the outer edge of the cuff 300 described infra. The zipper side 206B is adapted to be selectively connected to the zipper side 206A in a conventional manner to thereby attach the cuff 300 to the lens 200 which is adapted to be attached to the helmet shell 100, as described supra.

In an alternative embodiment, the zipper can be replaced by a suitable grip or engagement device which includes, for example, a deformable, grooved material which securely engages a bead on the lower edge of lens 200.

The cuff 300 is fabricated of a sheet of flexible material such as rayon or plastic or meltblown polypropylene. This material, typically breathable, acts as a filter for ambient air adjacent to the wearer's head. The cuff also serves as a protective barrier to prevent particulate material from being transmitted to or from the wearer to or from the ambient.

The cuff 300 includes an opening 305 which is designed to be able to pass over the wearer's head. In a preferred embodiment, an elastic band 302 is attached to the circumference of opening 305. The elastic band 302 can be stretched to pass over the head of the wearer and then contract to form a reasonably snug but comfortable fit of the cuff 300 around the wearer's neck. Alternatively, a tie, drawstring or other securing means can be used to contract the head opening 305. The cuff 300, thus, provides a protective barrier for the wearer's head.

In an alternative embodiment, it is contemplated that filter 400, facial shield 200 and protective cuff 300 can be joined together as a subassembly and placed over the helmet shell 100 to provide the filtering and protecting functions described.

Figure 5:
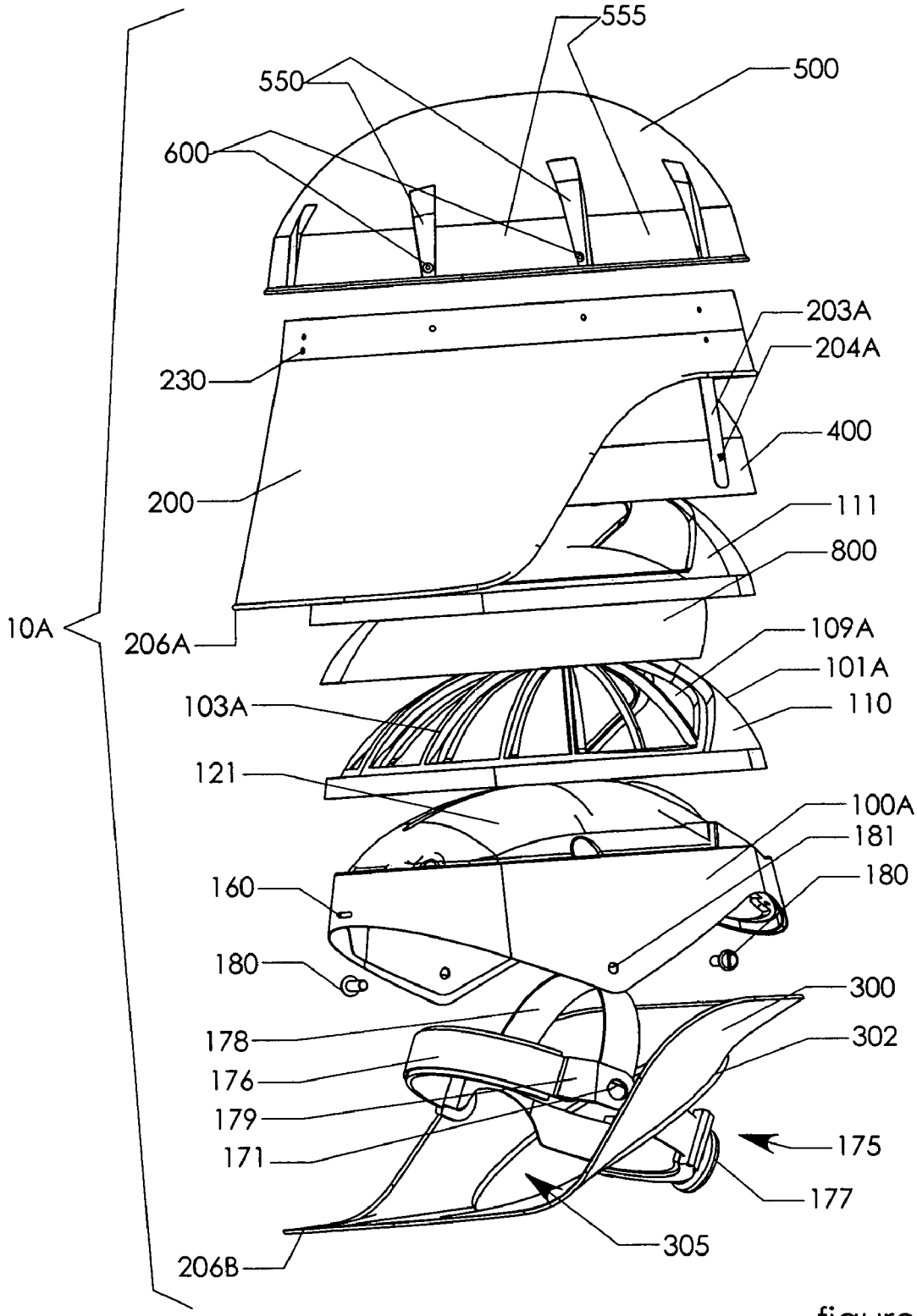
FIG. 5 is a frontal exploded view of another embodiment of the instant invention.

Referring now to FIG. 5, there is shown another embodiment of the instant invention. In this embodiment, components which are similar to previously described components bear similar reference numerals and the prior description is incorporated herewith.

Thus, the helmet assembly 10A includes the helmet shell 100A, the fan mechanism 108 mounted on the helmet shell, the outer filter (or protector) 500, the main filter 400, the facial shield 200, the cuff 300, and the headband assembly 175.

The headband 175 is used to seat the helmet 10 on the head of the wearer as described supra. The headband 175 is fairly conventional and is, also, optional. That is, a different head engaging support mechanism can be utilized or it can be omitted, if preferred.

Typically, the headband 175 includes the head-encircling band 176, an over-the-head strap 178, suitable attachment arms 179, for attachment to the helmet shell 100A by means of suitable fasteners 180 which can be pan screws or the like, as discussed supra.

The helmet shell 100A is, typically, formed of a lightweight material, such as PETG or Polycarbonate, for example as described supra. Helmet shell 100A is configured to conform, generally, to the shape of the upper portion of the wearer's head but to be spaced away from the top of the head of the wearer by the headband 175 described infra. In addition, as will be described infra, the helmet shell 100A is sufficiently sturdy so as to support a cooling or air moving mechanism 108, typically, e.g. a fan or the like. Helmet shell 100A, typically, has a closed upper surface 121.

In the embodiment of FIG. 5, a separate filter support 110 includes a plurality of radial ribs 103A which extend upwardly therefrom a fan covering 101*a* and an opening 109A, as described supra. The filter support 110 (also referred to as a supportive frame) is adapted to be mounted above the upper surface 121 of the helmet shell 100A such that ribs 103A radiate outwardly from the longitudinal center of the helmet shell 100A toward the perimeter thereof. A snap-in or frictional-fit assembly of the helmet shell 100A and filter support 110 is contemplated.

An optional post-filter 800 can be provided, if desired. The post-filter 800 can be fabricated of a material which is the same as filter 400, if so desired. Alternatively, to achieve a different filtration characteristic (or to reduce costs), the post-filter 800 can be fabricated of a material such as felt or activated carbon which is different from the material of filter 400. Of course, post-filter 800 can be omitted altogether, or used exclusively, if so desired. A retaining device 111 may be utilized to attach the post filter 800 to the support structure 110, if desired.

Filter 400, lens 200 and filter protector 500 are mounted to the other components in similar fashion as described in relation to Figures described supra.

Figure 6:
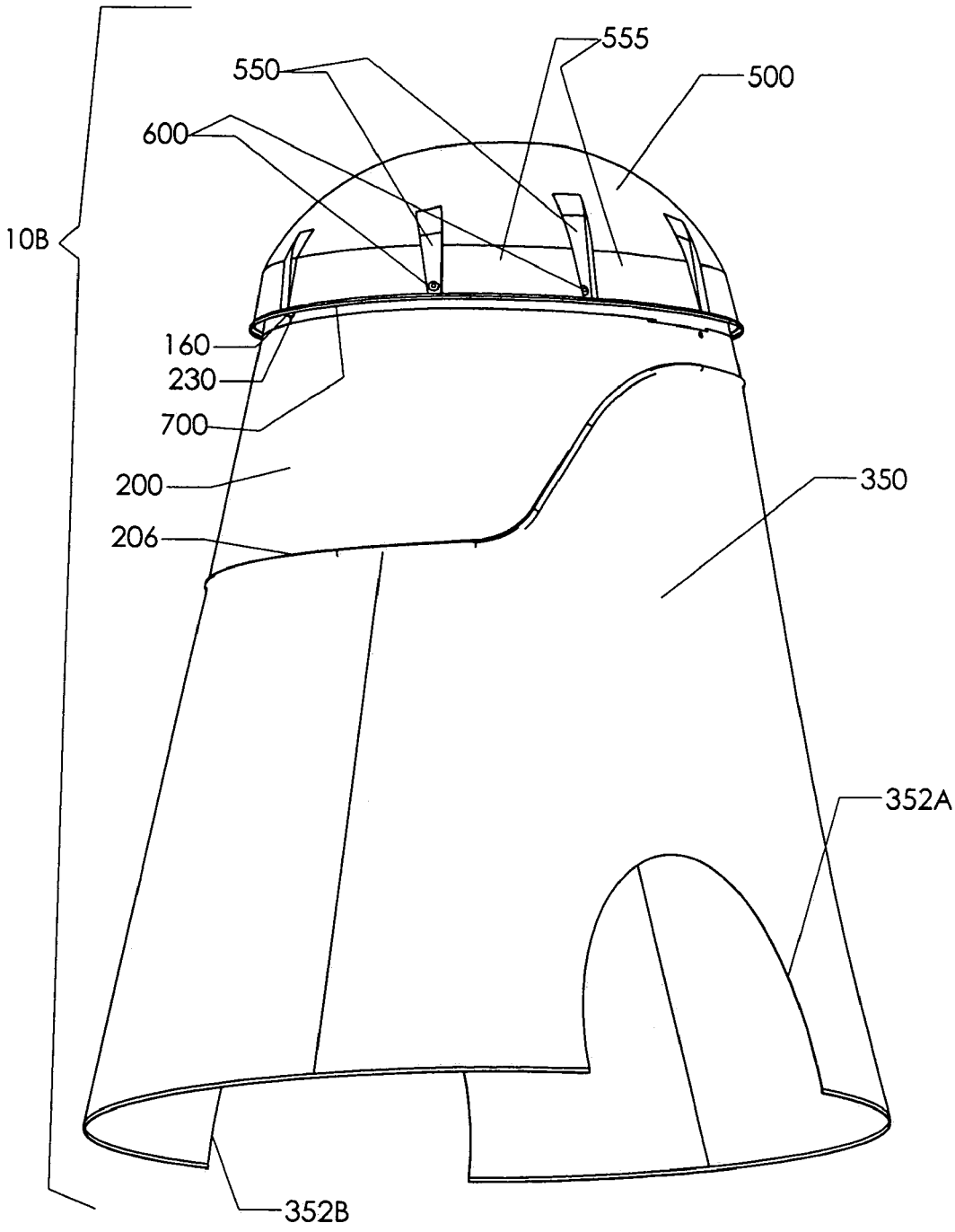
FIG. 6 is a perspective view of another embodiment of the instant invention.

Referring now to FIG. 6, there is shown another embodiment of the instant invention. In this embodiment, the headgear assembly 10B is similar to the headgear assembly 10 shown in FIG. 1 except for the lower filter protector structure 350 which can be used in place of cuff 300.

In this embodiment, the structure 350 (also referred to as a hood or shroud) is attachable to the lens 200 along the lower edge 206 by either a zipper 206, as shown in the embodiment of FIGS. 1-4, or a grooved, snap-on connector or any other suitable arrangement.

The shroud 350 is, typically, fabricated of polyethylene, polypropylene, synthetic fabric or other suitable material.

The shroud 350 is configured to extend to, and, as shown, below the shoulders of the wearer although the length of the shroud is selectable as desired.

In the configuration shown in FIG. 6, provision is made for the shroud 350 to fit over and conform to the shoulders of the wearer. In this instance, the shaped cutouts 352A and 352B are depicted. However, any suitable shape or even slits can be provided in the lower edges of the filter protector 350.

Figure 3:
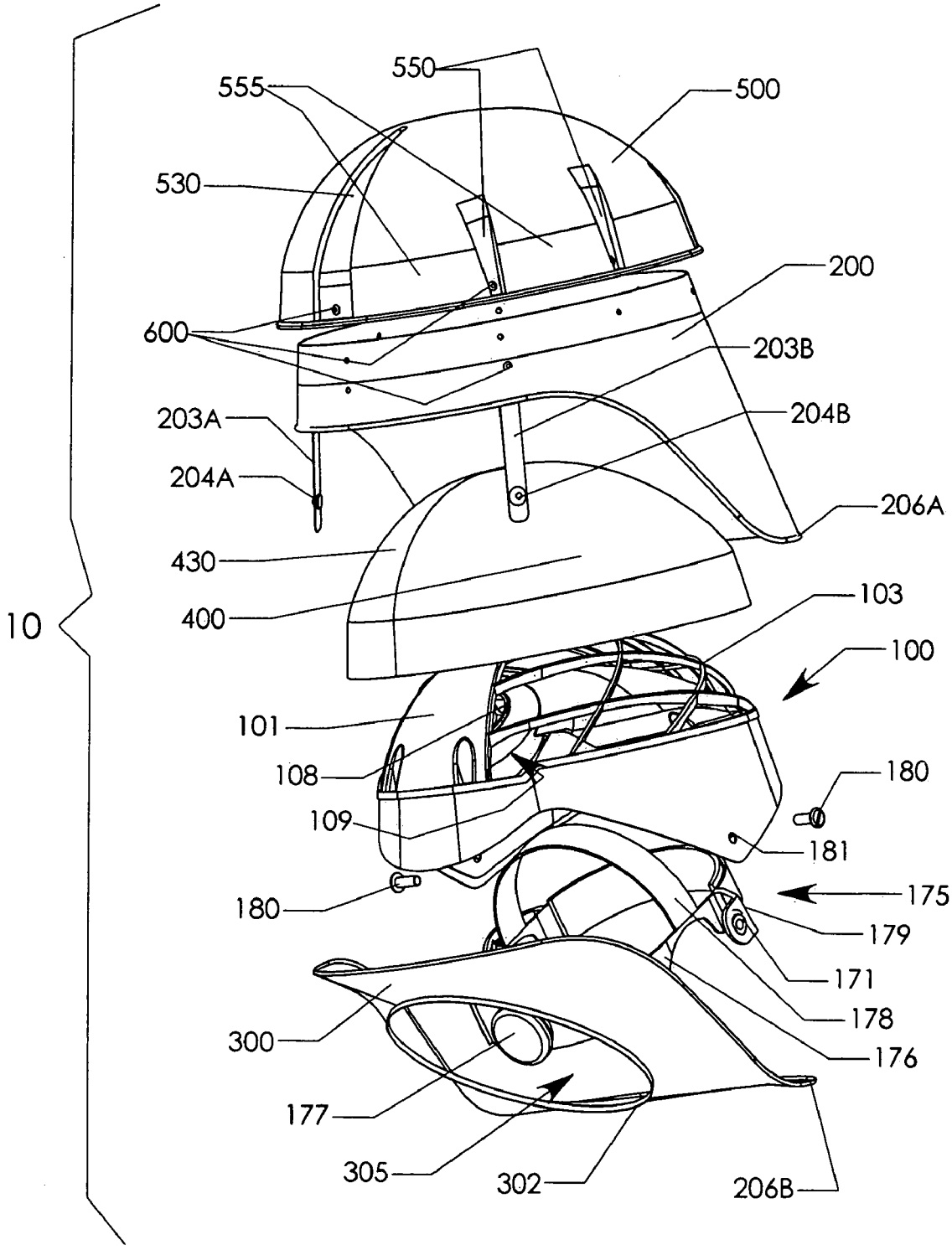
FIG. 3 is a rear exploded view of the embodiment of the helmet system shown in FIGS. 1 and 2.
Figure 4:
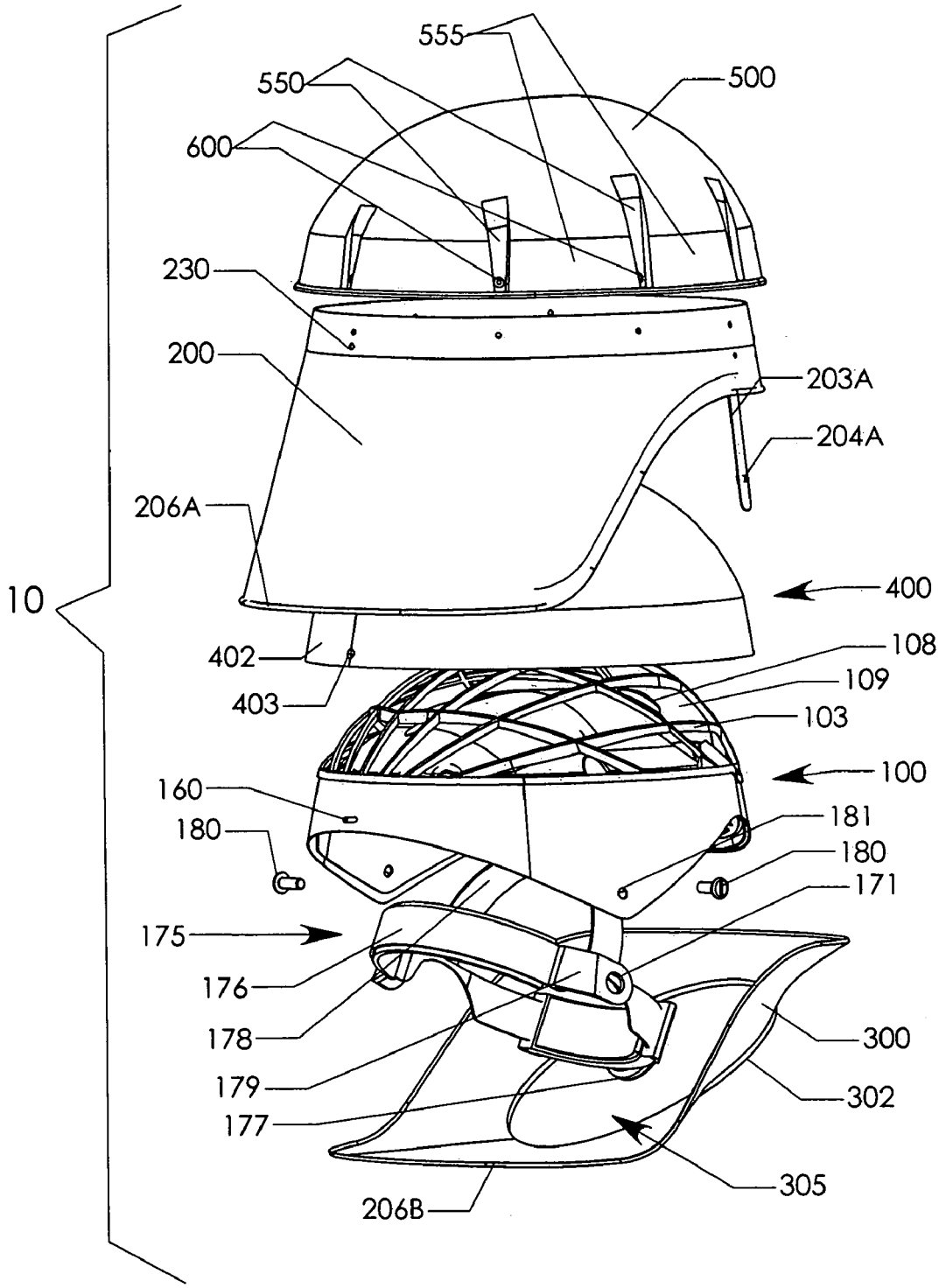
FIG. 4 is a frontal exploded view of the embodiment of the headgear structure of the instant invention as shown in FIGS. 1, 2 and 3.

In operation, the components shown in the exploded views of FIGS. 3, 4 and/or 5 are assembled as described supra. The assembled headgear structure is then placed over the head of the wearer by passing the cuff 300 or protective shroud 350 over the user's head and the headband 175 is adjusted appropriately. The headgear structure is now ready for use by the wearer who receives air through the gaps and filters. The filtered air is directed by fan 108 to the enclosed space created by the filters, helmet shield and cuff. This creates a clean air environment in proximity to the wearer's face.

Thus, there is shown and described a unique design and concept of a headgear system including an air filtration and control system. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

The invention claimed is:

1. A protective headgear system comprising, a supportive shell, a facial shield attached to said supportive shell by conforming said facial shield to the perimeter of said supportive shell, a filtration device formed of an air-infiltratable fibrous material mounted on top of said supportive shell so as to be supported thereby, and at least partially secured thereto by said facial shield, a protective covering mounted to the lower portion of said facial shield, and a filter protector fabricated of a rigid material positioned on top of said filtration device so as to cover said filtration device positioned thereunder, said filter protector thereby inhibiting damage to said filtration device by contact originating from above said filter protector, said filter protector including a plurality of discrete standoff sections spaced about at least a portion of a periphery of said filter protector where said filter protector is mounted to selected portions of said facial shield, thereby providing a space intermediate adjacent ones of said plurality of discrete standoff sections, each space permitting airflow therethrough to said filtration device.

2. The system recited in claim 1 wherein, at least portions of said filtration device are compressed between said plurality of discrete standoff sections of said filter protector and said facial shield.

3. The system recited in claim 1 including, a headband attached to the interior of said supportive shell for supporting the protective headgear system on a user thereof.

4. The system recited in claim 3 wherein, said facial shield and said filter protector are transparent to light.

5. The system recited in claim 1 wherein, said supportive shell includes at least one spacer device thereon for supporting said filtration device.

6. The system recited in claim 1 wherein, said filter protector includes a plurality of indented sections for forming said plurality of discrete standoff sections.

7. The system recited in claim 1 wherein, said protective covering comprises a layer of air permeable material.

8. The system recited in claim 1 wherein, said protective covering includes an aperture therein.

9. The system recited in claim 8 wherein, said protective covering includes an adjustable closure means for closing said aperture.

10. The system recited in claim 9 wherein, said adjustable closure means comprises an elastic element around at least a portion of said aperture.

11. The system recited in claim 1 wherein, said filter protector is removably attached to said facial shield.

12. The system recited in claim 1 wherein, said protective covering is mounted to said facial shield below said supportive shell.

13. The system recited in claim 1 wherein, said supportive shell, facial shield and filter protector are fabricated of a class of plastic materials identified as PETG or polycarbonate.

14. The system recited in claim 1 including, fan means mounted to said supportive shell below said filtration device.

15. The system recited in claim 14 including, a fan covering mounted to said supportive shell to provide a protective cover for said fan means and to maintain a distance between said supportive shell and said filtration device.

16. The system recited in claim 1 wherein, said protective covering is fabricated of a flexible breathable material which prevents transmission of particulate material therethrough.

17. The system recited in claim 1 including, a supportive frame, and a filter device mounted on top of said supportive frame, said supportive frame and said filter device are mounted intermediate said filtration device and said supportive shell.

18. The system recited in claim 17 wherein, said filter device conforms to the shape of said supportive frame.

19. The system recited in claim 17 including, a support means on said supportive shell to space said filtration device away from said supportive shell.

20. A protective headgear system comprising, a supportive shell fabricated of one of a PETG or a polycarbonate plastic material, a facial shield attached to said supportive shell by conforming said facial shield to the perimeter of said supportive shell, a filtration device formed of an air-infiltratable fibrous material mounted on top of said supportive shell so as to be supported thereby, and at least partially secured thereto by said facial shield, a protective covering mounted to the lower portion of said facial shield, and a filter protector fabricated of one of a PETG or a polycarbonate plastic material positioned on top of said filtration device so as to cover said filtration device positioned thereunder, said filter protector thereby inhibiting damage to said filtration device by contact originating from above said filter protector, said filter protector including a plurality of discrete standoff sections spaced about at least a portion of a periphery of said filter protector where said filter protector is mounted to selected portions of said facial shield, thereby providing a space intermediate adjacent ones of said plurality of discrete standoff sections, each space permitting airflow therethrough to said filtration device.

* * * * *